US005573392A

United States Patent [19]

Paikert et al.

[11] Patent Number: 5,573,392

[45] Date of Patent: Nov. 12, 1996

[54] METHOD AND DEVICE FOR DISTRIBUTING FUEL IN A BURNER SUITABLE FOR BOTH LIQUID AND GASEOUS FUELS

[75] Inventors: Bettina Paikert, Oberrrohrdorf, Switzerland; Peter Senior, Stoney Stanton, Great Britain

[73] Assignee: ABB Research Ltd., Zurich, Switzerland

[21] Appl. No.: 496,190

[22] Filed: Jun. 28, 1995

[30] Foreign Application Priority Data

Jul. 13, 1994 [DE] Germany ..... 44 24 639.0

[51] Int. Cl.[6] ..... F23Q 9/00

[52] U.S. Cl. ..... 431/9; 431/10; 431/284; 431/285; 431/351; 431/354

[58] Field of Search ..... 431/10, 9, 354, 431/351, 284, 285; 239/403, 405, 406; 60/737

[56] References Cited

U.S. PATENT DOCUMENTS

| | | | |
|---|---|---|---|
| 3,570,242 | 3/1971 | Leonard et al. | 60/737 |
| 5,423,674 | 6/1995 | Knopfel et al. | 431/9 |
| 5,453,004 | 9/1995 | Hofbauer | 431/9 |

FOREIGN PATENT DOCUMENTS

| | | |
|---|---|---|
| 0321809 | 6/1989 | European Pat. Off. . |
| 3642122C1 | 6/1988 | Germany . |
| 4306956A1 | 9/1994 | Germany . |
| 2226123 | 6/1990 | United Kingdom . |

OTHER PUBLICATIONS

"Airblast Atomization", Lefebvre, A. H., Prog. Energy Combust. Sci., vol. 6, pp. 233–261, 1980.

*Primary Examiner*—Carroll B. Dority
*Attorney, Agent, or Firm*—Burns, Doane, Swecker & Mathis

[57] ABSTRACT

In order to improve the combustion of the liquid fuel (4) in such a burner (1) without influencing that of the gaseous fuel (7), the liquid fuel (4) is directed at high flow and swirl velocity into the settling chamber (13) of the airblast nozzle (2). Then the flow and swirl velocity is reduced and a thin fluid film is formed on the prefilming lip (15). The blast air (15) is directed with a quantity ratio of less than 1:1 to the liquid fuel (4) into the airblast nozzle (2) and separates small fuel droplets at the tip (27) of the prefilming lip (15).

In a double-cone burner (1), the combustion mixture (28) is injected against the swirl of its main air flow (8) and at a spray angle (26) of less than or equal to 30°.

6 Claims, 2 Drawing Sheets

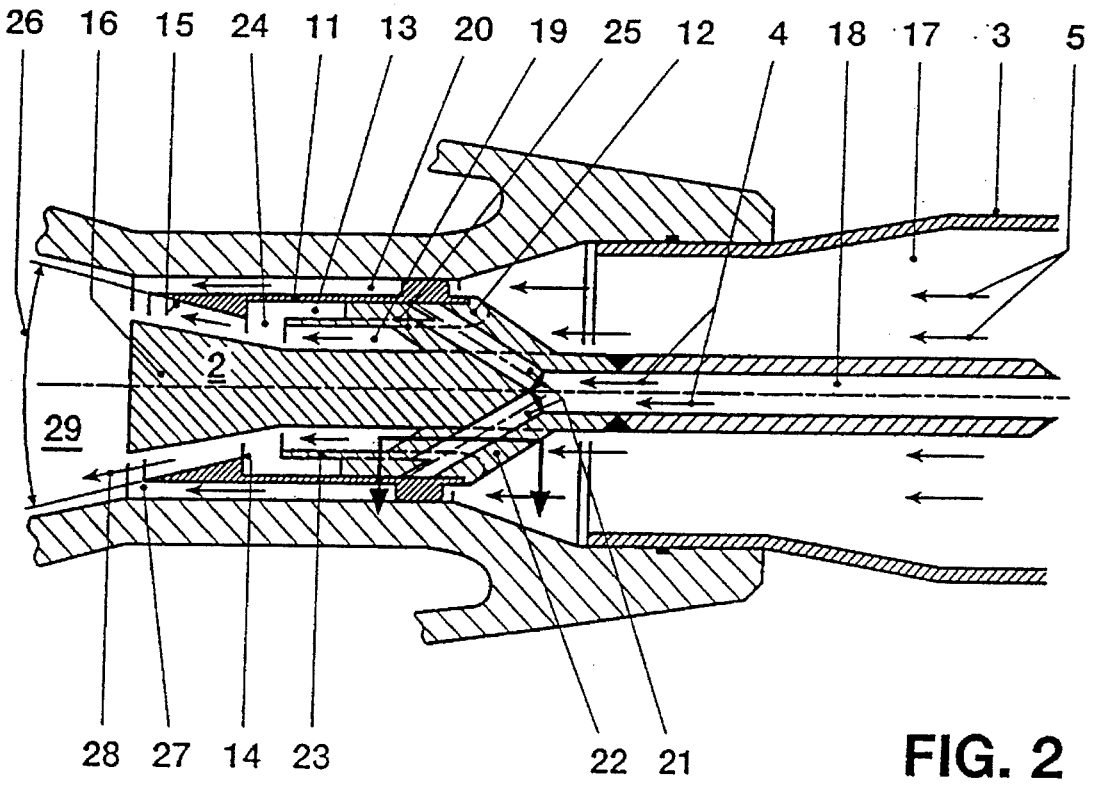
FIG. 2
FIG. 3
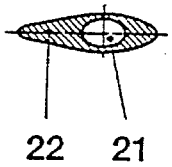
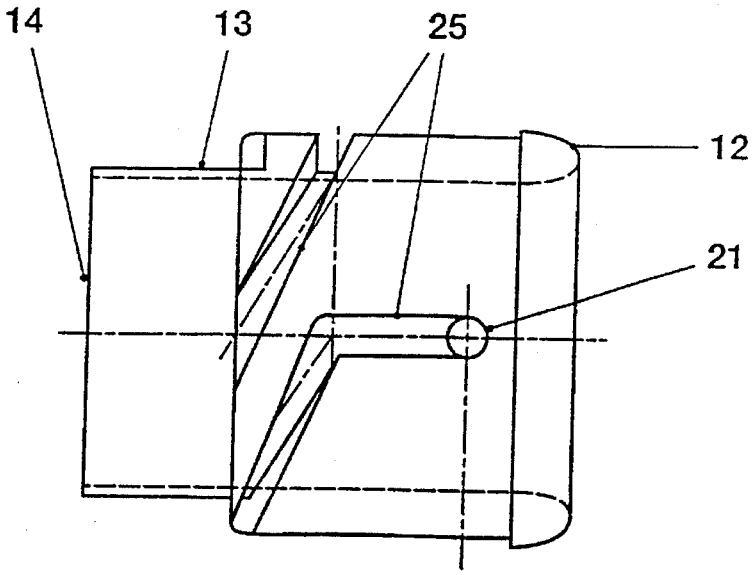
FIG. 4

METHOD AND DEVICE FOR DISTRIBUTING FUEL IN A BURNER SUITABLE FOR BOTH LIQUID AND GASEOUS FUELS

BACKGROUND OF THE INVENTION

1. Field of the Invention

The invention relates to a method and a device for the distribution of fuel in a burner for gas turbines and heating boilers which is suitable for both liquid and gaseous fuels and has an airblast nozzle.

2. Discussion of Background

A plurality of airblast nozzles are disclosed by Lefebvre "Airblast atomization", Prog. Energy Combust. Sci. Vol. 6, p. 239 ff. They each consist of a liquid-fuel line, an annular airblast line and a prefilming tube.

The liquid-fuel line is either directed radially into the airblast nozzle (ibid, FIG. 7) or is arranged axially in the fuel lance, i.e. inside the airblast line (ibid, FIG. 5). Here, it can be connected to the prefilming tube directly or via distribution lines. The prefilming tube consists of a swirl generator having an integrated settling chamber, a weir, a prefilming lip, and a central nozzle pin arranged as counterpart to the prefilming lip. The airblast line is subdivided by the prefilming tube into an inner and an outer line in each case.

During operation with liquid fuel, this fuel is passed from the feed line into the settling chamber and from there via the weir onto the prefilming lip, where a film of liquid fuel forms. This film of liquid fuel is atomized at the tip of the prefilming lip by means of blast air from the inner and outer airblast line and the resulting fuel drops are injected into the inner space of the burner.

Lefebvre shows, inter alia, the following possibilities of obtaining good atomization, i.e. of forming relatively small fuel droplets:

a) An optimum quantity ratio of atomization air to liquid fuel of 4:1 to 5:1 (ibid, FIG. 15); therefore the atomization quality deteriorates below a quantity ratio of 4:1, whereas only small improvements in the atomization can be achieved above a quantity ratio of 5:1 by feeding larger air quantities. However, if this quantity ratio drops below 2:1, according to Lefebvre a considerable impairment in the atomization quality can be found.

b) Maximum physical contact of the atomization air with the liquid fuel; therefore the prefilming angle and thus the spray angle of the airblast nozzles are made relatively large at about 45° to 60° (ibid, FIG. 6, FIG. 7). However, this requires a relatively intensive swirl of the fuel.

c) As high a velocity as possible of the atomization air sweeping past on both sides of the prefilming lip (ibid, FIG. 15); here, higher velocities of the atomization air are not only able to provide for a better atomization quality but they are also said to prevent liquid fuel from striking the inner surface of the burner or the airblast nozzle.

Increased fuel velocities occur at the weir edge of such an airblast nozzle transversely to the prefilmer. Consequently, the separation of fuel droplets and/or the forming of a relatively thick film of liquid fuel already occurs at this point. Both effects counteract the development of small fuel droplets and thus adversely affect the combustion. In addition, the fuel drops can strike the nozzle wall and thus increase the risk of carbonization. In the prior art cited, these disadvantages are countered through the use of a large air quantity in relation to the fuel quantity. However, such a large air charge in the airblast nozzle is very unfavorable during operation with gaseous fuel, since this destabilizes the gas flame and greatly reduces its lean extinction limit. The known airblast nozzles are of small dimensions in the area in front of the weir edge and are thus susceptible to carbonization. On account of their large spray angle, portions of the liquid fuel can reach the inner surface of the burner and cause overheating there. In addition, the atomization quality is impaired.

SUMMARY OF THE INVENTION

Accordingly, one object of the invention, in avoiding these advantages, is to provide a novel method and a device for distributing fuel in a burner suitable for both liquid and gaseous fuels, which method and device improve the combustion of the liquid fuel without influencing that of the gaseous fuel.

According to the invention, this is achieved when, in a method in which the liquid fuel is directed at a high flow and swirl velocity into the settling chamber. The flow and swirl velocity of the liquid fuel is reduced in the settling chamber. Finally, the blast air is directed with a quantity ratio of less than 1:1 to the liquid fuel into the airblast nozzle. It separates small fuel droplets from the fluid film at the tip of the prefilming lip. The resulting combustion mixture is then injected into the inner space of the burner.

To this end, a swirl generator is arranged inside the prefilming tube and in a manner known per se in the direction of flow directly in front of the settling chamber. The swirl generator has a plurality of azimuthal-axial circumferential grooves. The dividing wall, known per se, of settling chamber and inner blast-air line ends at such a distance in front of the weir that an open free space results between the latter and the dividing wall. Its width corresponds to at least twice the vertical extension of the settling chamber in its area arranged further upstream. The susceptibility of the airblast nozzle to carbonization is thereby clearly reduced.

On account of the arrangement of the azimuthal-axial circumferential grooves, a relatively large swirl is first of all induced in the liquid fuel. This swirl, together with the high flow velocity of the liquid fuel, provides for its uniform distribution in the settling chamber. The expansion of the swirl grooves in the settling chamber results in a rapid reduction in the initial swirl further downstream in the area of the free space. In addition, the flow velocity of the liquid fuel is reduced. A thin fluid film of the liquid fuel can therefore form on the prefilming lip without the effect of excessively large radial forces. At the tip of the prefilming lip, the blast air flows around the fluid film on both sides, in the course of which relatively small liquid-fuel droplets become detached on account of the shearing force, which liquid-fuel droplets are entrained by the blast air.

As a result of this advantageous, very fine atomization of the liquid fuel, improved combustion is achieved in the combustion chamber. Only a fluid prefilmer of this type enables the quantity of blast air required to be substantially reduced and nonetheless enables good atomization of the liquid fuel to be achieved. In addition, the very small air charge in the airblast nozzle during operation with gaseous fuel stabilizes the gas flame and thus improves its lean extinction limit compared with conventional airblast nozzles. An additional advantage is rooted in the fact that there is also less disturbance to the premixing stage of the burner during a reduced requirement for blast air, which likewise improves the combustion. In particular in the case of combustion chambers cooled by convection, it is possible on account of the low air requirement to feed the blast air from the plenum arranged in front of the combustion chamber. This results in a substantially larger, additional pressure loss via the airblast nozzle and thus an improved atomization quality.

By means of such an airblast nozzle, the fuel mixture can be injected especially advantageously into the inner space of a double-cone burner at a spray angle of less than or equal to 30° as well as against the swirl of its main air flow.

To this end, the azimuthal-axial circumferential grooves are orientated in the opposite direction to the circumferential direction of the swirl of the main air flow of the double-cone burner. The spray angle of the airblast nozzle is designed to be less than or equal to 30°.

On account of the small spray angle, the resulting combustion mixture can be injected further into the centre of the burner than is possible in the solutions of the prior art. The liquid-fuel or combustion-mixture swirl directed in the opposite direction to the main air flow of the double-cone burner counteracts the spinning-out of the fuel droplets from the center of the burner. Thus the combustion mixture can be prevented from striking the inner surface of the burner.

Furthermore, it is advantageous when the distribution pipes in the area of the inner blast-air line are enclosed by ribs of wing-shaped profile. The flow of the blast air in the inner blast-air line is thus improved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 shows a partial longitudinal section of the burner in the area of the airblast nozzle;

FIG. 3 shows the wing profile of the rib in accordance with FIG. 2 shown in the direction of the arrows;

FIG. 4 shows a plan view of the swirl generator having the azimuthal-axial circumferential grooves, in enlarged representation;

DESCRIPTION OF THE PREFERRED EMBODIMENTS

Figure 1:
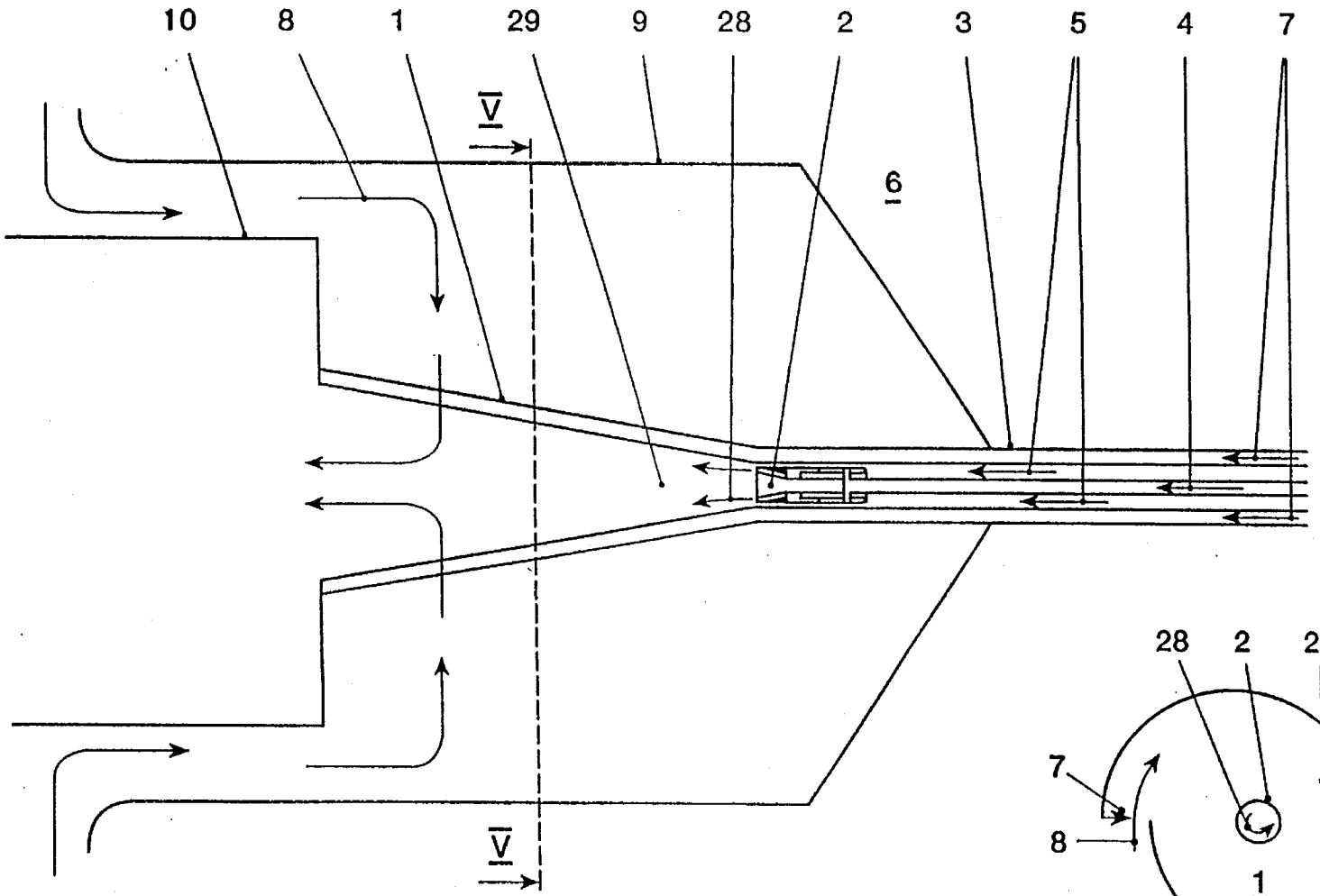
FIG. 1 shows a schematic representation of the arrangement of the burner equipped with an airblast nozzle.

Referring now to the drawings, wherein like reference numerals designate identical or corresponding parts throughout the several views, only the elements essential for understanding the invention are shown. Elements of the system which are not shown are, for example, the fastening of the burner. The direction of flow of the working media is designated by arrows.

In FIG. 1 an airblast nozzle 2 is arranged in the upstream end of a burner 1 designed as a double-cone burner. It is supplied with liquid fuel 4 and blast air 5 via a fuel lance 3 connected to it. Alternatively, the blast air 5 can also be fed via openings (not shown here) in the fuel lance 3 from a plenum 6 located in front of the double-cone burner 1. In addition, the fuel lance 3 delivers the gaseous fuel 7 for the double-cone burner 1, whereas the burner 1 receives a main air flow 8 from the space inside the burner hood 9. The double-cone burner 1 leads into the combustion chamber 10 downstream (FIG. 1).

The airblast nozzle 2 consists of a prefilming tube 11 in which a swirl generator 12, a settling chamber 13, a weir 14, a prefilming lip 15 and a central nozzle pin 16 designed as a counterpart to the prefilming lip 15 are arranged (FIG. 2). It is connected to an annular airblast line 17 and a liquid-fuel line 18. The prefilming tube 11 subdivides the blast-air line 17 into an inner 19 and an outer 20 blast-air line.

The liquid-fuel line 18 is arranged centrally inside the blast-air line 17 and has a plurality of distribution lines 21 to the prefilming tube 11. The distribution lines 21 are accommodated in the area of the inner blast-air line 19 by ribs 22 of wing-shaped profile (FIG. 2, FIG. 3). The liquid-fuel line 18 can of course also be connected radially to the airblast nozzle 2.

Formed between the settling chamber 13 and the inner blast-air line 19 is a dividing wall 23 which ends at such a distance in front of the weir 14 that an open free space 24 results between the latter and the dividing wall 23, the width of which free space 24 corresponds to at least twice the radical dimension of the settling chamber 13 in its area arranged further upstream (FIG. 2).

A plurality of azimuthal-axial circumferential grooves 25 are formed in the swirl generator 12 (FIG. 4) and are orientated in the opposite direction to the circumferential direction of the main air flow 8 of the double-cone burner 1. The spray angle 26 of the airblast nozzle 2 is about 30° (FIG. 2).

The liquid fuel 4 coming at a high velocity out of the liquid-fuel line 18 is first of all given a relatively large swirl induced by the azimuthal-axial circumferential grooves 25 of the swirl generator 12. Both the swirl and the velocity of the liquid fuel 4 provide for its uniform distribution in the settling chamber 13. Further downstream, in the area of the free space 24, the swirl and the velocity decrease so that a thin fluid film of the liquid fuel 4 is formed on the prefilming lip 15.

Other swirl devices, e.g. swirl blades (not shown here), can also be used with a similar effect as the circumferential grooves 25.

Figure 5:
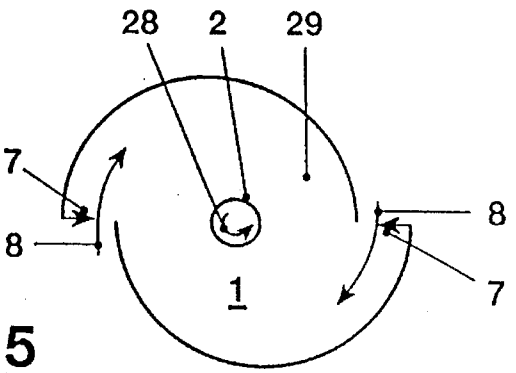
FIG. 5 shows section V—V through the burner in FIG. 1, in enlarged representation.

The blast air 5, flowing with a quantity ratio of less than 1:1 to the liquid fuel 4 into the inner and outer blast-air lines 19, 20 of the airblast nozzle 2, flows around the prefilming lip 15 on both sides and separates small fuel droplets from the fluid film at its tip 27 on account of the shearing force, which fuel droplets are entrained by the blast air 5. The resulting combustion mixture 28 is then injected into the inner space 29, designed as a conical hollow space, of the double-cone burner 1, with a spray angle 26 of about 30° as well as against the swirl of its main air flow 8 (FIG. 5).

As a result of the small spray angle 26, the combustion mixture 28 is injected into the center of the conical hollow space 29 and is uniformly distributed there on account of its residual swirl still present, which is orientated against the swirl of the main air flow 8 of the double-cone burner 1. The combustion mixture 28 is thereby also prevented from striking the inner surface of the double-cone burner 1.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for distributing fuel in a liquid and gas fueled burner having an airblast nozzle at an inlet to the burner, comprising the steps of:

directing liquid fuel at a predetermined flow rate, velocity and swirl into a settling chamber of an airblast nozzle;

reducing the flow velocity and swirl velocity of the liquid fuel as it moves from the settling chamber to a prefilming lip of the airblast nozzle, wherein, the liquid fuel forms a fluid film on the prefilming lip;

introducing blast air into the airblast nozzle at a flow rate ratio of less than 1:1 to the flow rate of the liquid fuel;

dividing the blast air into a flow on a radially inner side of the prefilming lip and a flow on a radially outer side of the prefilming lip;

atomizing the liquid fuel at a tip of the prefilming lip by air passing on radially inner and radially outer sides of the tip, and injecting the atomized fuel as a constituent of a combustion mixture into an inner space of the burner.

2. A device for distributing fuel in a liquid and gas fueled burner, comprising an airblast nozzle mountable at an inlet to a burner to inject a fuel and air mixture into the burner;

means for introducing blast air into the airblast nozzle; and means for introducing a liquid fuel into the airblast nozzle;

wherein the airblast nozzle comprises a prefilming tube for guiding a liquid fuel flow through the nozzle in a flow direction, the prefilming tube connected to said means for introducing air so that air flows radially inward and radially outward of the prefilming tube, at least one fuel distribution line connected to deliver liquid fuel into the prefilming tube from said means for introducing a liquid fuel, a nozzle pin disposed coaxially in the prefilming tube and extending axially therewith, a dividing wall disposed coaxially in the prefilming tube, wherein a space between the dividing wall and the nozzle pin defines an inner air passage, and a space between the dividing wall and the prefilming tube defines a settling chamber for liquid fuel, a swirl generator disposed between the at least one distribution line and the settling chamber to produce a swirl in the liquid fuel flow, the swirl generator having a plurality of azimuthal-axial circumferential grooves, a weir formed on the prefilming tube downstream of the settling chamber, and a prefilming lip formed on the prefilming tube downstream of the weir, wherein between a downstream edge of the dividing wall and the weir is formed an open free space having an axial length at least twice a radial distance between the dividing wall and the prefilming tube at the settling chamber.

3. The method of distributing fuel as claimed in claim 1, wherein the burner has a conically shaped inner space having openings for a tangentially entering main air flow, and the combustion mixture is injected into the inner space of the burner at a spray angle not greater than 30° and being oriented against a direction of the swirl of the main air flow entering the inner space.

4. The method of distributing fuel as claimed in claim 3, wherein the step of directing liquid fuel into the settling chamber includes orienting the swirl of the liquid fuel against a direction of the swirl of the main air flow of the burner.

5. The device for distributing fuel as claimed in claim 2, further comprising a double-cone burner comprising two conical-section bodies mounted to form a conical inner space and having inlet openings for a tangentially directed main flow into the inner space so that the flow in the inner space has a swirl, and wherein the azimuthal-axial circumferential grooves are oriented in an opposite direction to a circumferential direction of the swirl of the main air flow (8), and the airblast nozzle is configured to introduce the fuel and air mixture into the burner with a spray angle not greater than 30°.

6. The device as claimed in claim 2, wherein the distribution lines in the area of the inner air passage are enclosed by ribs of wing-shaped profile.

* * * * *